United States Patent [19]

Otte

[11] 4,364,556

[45] Dec. 21, 1982

[54] EMERGENCY SHUT-OFF SWITCH AND FRAME ASSEMBLIES FOR EXERCISE APPARATUS

[75] Inventor: Gary Otte, Brazil, Ind.

[73] Assignee: Nissen Corporation, Cedar Rapids, Iowa

[21] Appl. No.: 198,653

[22] Filed: Oct. 20, 1980

[51] Int. Cl.[3] ..... A63B 23/06

[52] U.S. Cl. ..... 272/69; 200/61.85

[58] Field of Search ..... 272/69; 191/1 R; 200/61.85, 157; 73/379; 128/25 R

[56] References Cited

U.S. PATENT DOCUMENTS

| | | | |
|---|---|---|---|
| 921,755 | 5/1909 | Volk | 272/69 |
| 937,795 | 10/1909 | Hackney | 272/69 |
| 1,231,056 | 6/1917 | Palmer et al. | 200/61.85 X |
| 1,589,977 | 6/1926 | Lucas | 200/157 |
| 2,370,420 | 2/1945 | Rayburn | 191/1 R X |
| 2,399,915 | 5/1946 | Drake | 272/69 |
| 3,332,683 | 7/1967 | Rand | 273/55 |
| 3,518,985 | 7/1970 | Quinton | 128/2.06 |
| 3,643,943 | 2/1972 | Erwin, Jr. et al. | 272/69 |
| 3,659,845 | 5/1972 | Quinton | 272/69 |
| 3,711,812 | 1/1973 | Cherry | 272/69 X |
| 3,731,917 | 5/1973 | Townsend | 272/69 |
| 3,737,163 | 6/1973 | Sumrall | 272/69 |
| 4,192,982 | 3/1980 | Schnizler, Jr. et al. | 200/61.85 X |
| 4,270,032 | 5/1981 | Dobberpuhl | 200/61.85 |

FOREIGN PATENT DOCUMENTS

| | | | |
|---|---|---|---|
| 1114558 | 10/1961 | Fed. Rep. of Germany | 191/1 R |
| 256218 | 2/1949 | Switzerland | 200/61.85 |

*Primary Examiner*—Richard C. Pinkham
*Assistant Examiner*—Arnold W. Kramer
*Attorney, Agent, or Firm*—Fleit & Jacobson

[57] ABSTRACT

An emergency shut-off switch assembly and a frame assembly for use with a treadmill-type exercise apparatus. The switch assembly includes handles connected to an upper portion of a housing assembly of the exercise apparatus. Independent shut-off switches for substantially instantaneously de-energizing a motor of the apparatus are closely spaced from lower ends of each of the handles in such manner that a downward force greater than a predetermined amount on either of the handles actuates its associated switch. Actuation of the switch results in substantially instantaneous stopping of the belt of the apparatus. The frame assembly includes supports for adjustably connecting ends of an axle of an idler pulley to the frame assembly so that the angular orientation of the axle with respect to the frame assembly is adjustable and pulleys are easily removed or replaced. Also, one end of a driven pulley of the apparatus is adjustably connected to the frame assembly. Further, a motor used to drive the driven pulley is mounted to the frame assembly in such manner that the motor is translatable with respect to the frame assembly to rapidly and precisely adjust tension in a belt interconnecting the motor with the driven pulley.

4 Claims, 15 Drawing Figures

FIG. 8
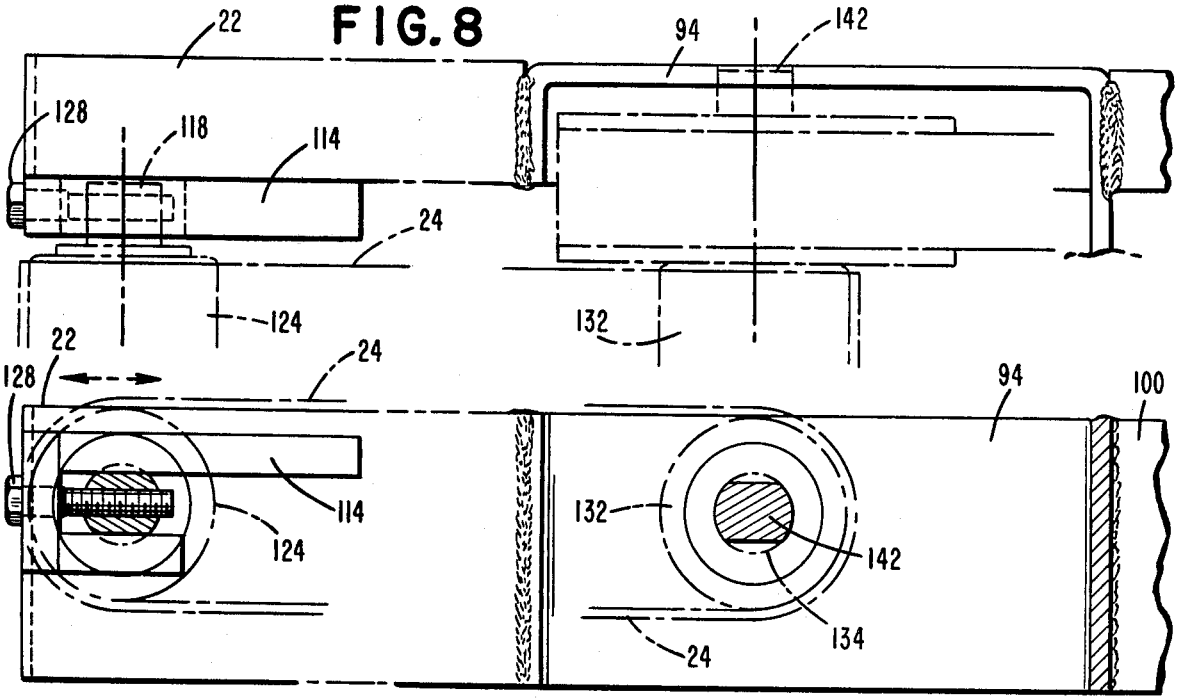
FIG. 7
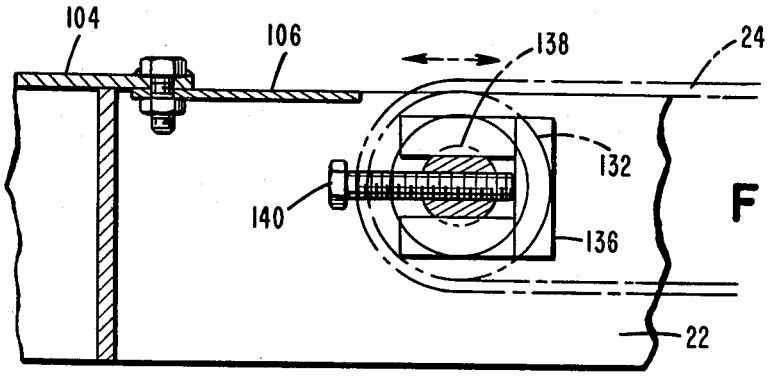
FIG. 6
FIG. 5
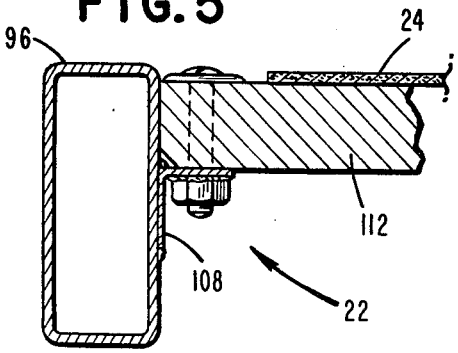
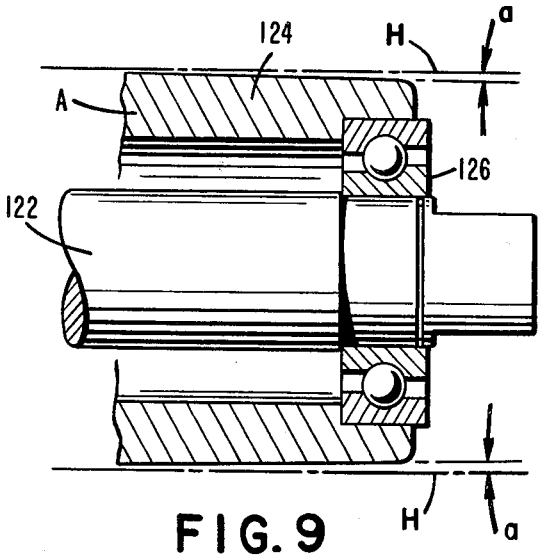
FIG. 9

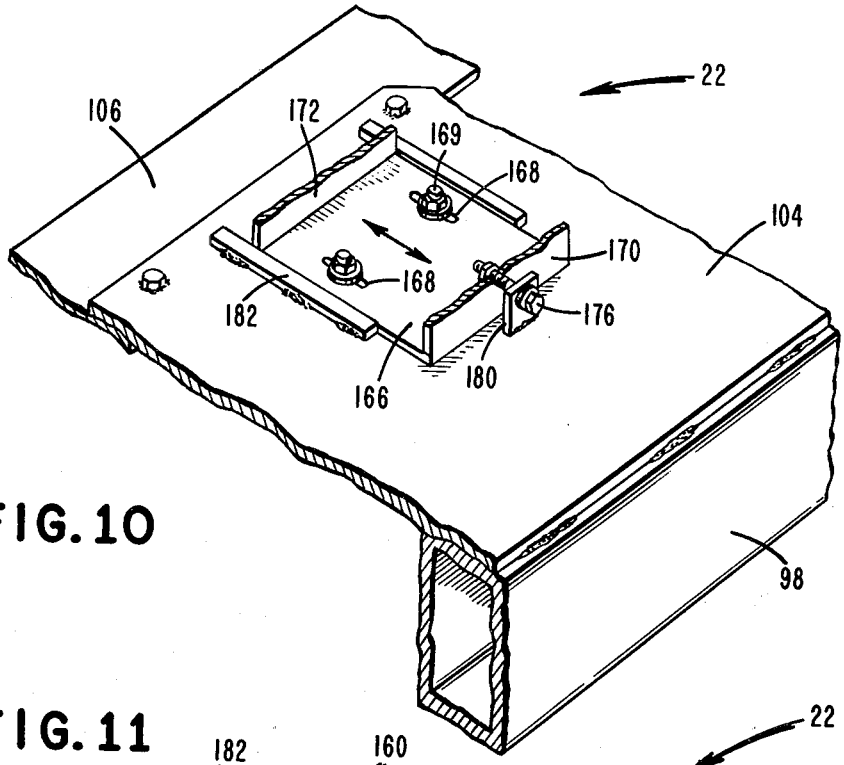
FIG. 10
FIG. 11
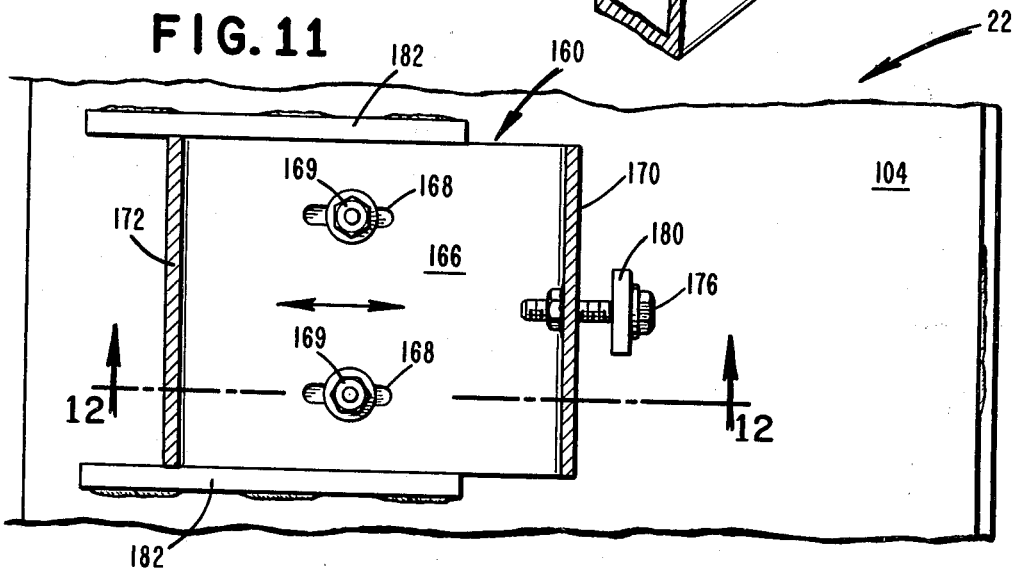
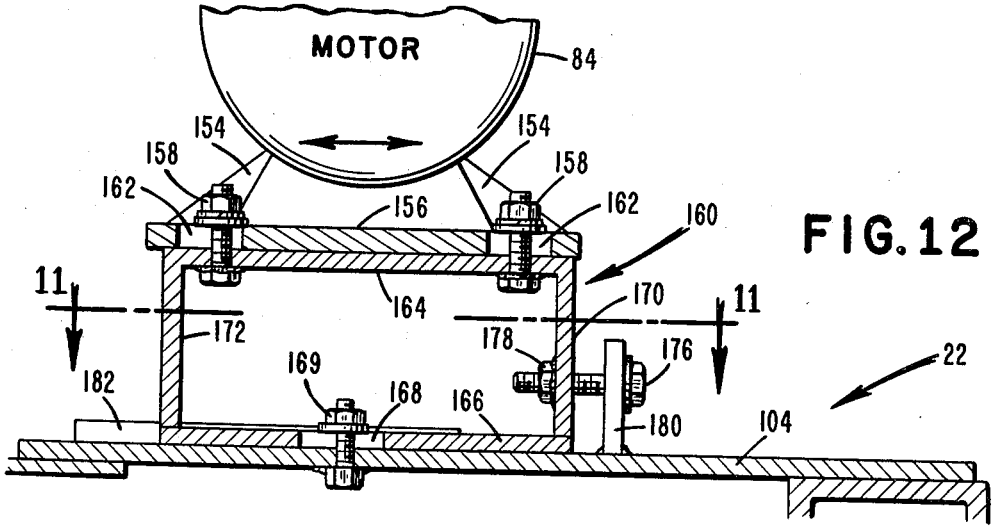
FIG. 12

EMERGENCY SHUT-OFF SWITCH AND FRAME ASSEMBLIES FOR EXERCISE APPARATUS

BACKGROUND OF THE INVENTION

Field of the Invention

The present invention relates to a treadmill-type exercise apparatus. More particularly, the invention relates to an emergency shut-off switch assembly for quickly deactivating such an exercise apparatus and a frame assembly for adjustably holding a movable belt and motor used with the apparatus.

A machine denoted as a treadmill has been known for many centuries. Originally, the treadmill was used to obtain a motive force through the action of a human or an animal walking on an endless belt of the treadmill. Even though the treadmill is not an efficient device in modern times for producing motive power, nevertheless, treadmills are still quite evident. The modern treadmill is the same ancient machine; however, it is operated in the reverse direction, i.e., as a motor instead of as a generator.

The treadmill today is utilized as an exercising device, wherein an electric motor is employed to drive the endless belt, thereby forcing a person utilizing the machine to move his or her legs at a rate which will prevent the person from being thrown off the exercise device. In a typical operation of an exercise machine, the participant or attending personnel selects the desired walking or running speed, and the endless belt is driven at a rate corresponding to this selected speed. In order to cause the participant to exert more energy, the rate is increased until a brisk walk or a run is involved.

Another current use for such exercising machines is the now popular "stress test", which is employed to determine the extent of the stresses placed upon a person's cardiovascular system by strenuous exercise. A stress test may be conducted by a physician as a part of a person's routine physical check-up. It has also become the practice today for health fitness facilities to request that members undergo a stress test, prior to engaging in a continuous program of exercise, such as jogging, swimming, or working out, at the health spa. Typically, a person exercises on the treadmill and heart rate, blood pressure, and the like, are monitored to determine if the person is capable of undergoing strenuous exercise and at what level of exercise the person's activities should be diminished.

Needless to say, it is an important consideration in the use of an exercise device, such as a motor-driven treadmill, that when one desires to stop the treadmill, such action should occur immediately. In the event that the belt is being driven at a speed which is higher than the participant can achieve and maintain comfortably, quite frequently the participant is forceably thrown from the belt. This is, of course, an uncomfortable situation and may easily result in an injury. Additionally, when the exercise device is being utilized in the stress-tests situation, it is possible that a person may feel uncomfortable and in fact be aware that he is being stressed above his limitations before the health personnel can determine that this is the case. In such situations, the machine should be immediately shut off to prevent overstressing the participant.

Typical exercise machines, of course, employ an on-off switch; however, such switches are either inaccessible or difficult to manipulate immediately, so as to instantaneously stop the action of the endless belt.

Another problem encountered with treadmill-type exercise apparatus is insuring proper alignment of the belt used with such apparatus with the frame of the apparatus and maintaining proper tension on the endless belt to avoid excess slippage or binding of the belt during its rotation with respect to a fixed support of the apparatus. Also, problems have been encountered in insuring proper alignment between a pulley driving the belt and a motor connected to the pulley by a drive belt. Also, problems have been encountered in maintaining precise and appropriate tension in the drive belt. Also obtaining rapid removal and installation of running belt pulleys has been difficult.

BRIEF SUMMARY OF THE INVENTION

The present invention provides an emergency switch assembly for use on exercise apparatus which is easily actuatable by a user of the machine and serves to stop immediately the drive function of an endless belt of the apparatus. The switch assembly includes large protruding handles, which are of a curved design, and which may be easily grasped by the participant. Independent safety switch assemblies are operatively associated with each of the handles. The extent of travel necessary to activate the switches of the switch assemblies is extremely short and, thereby, permits almost instantaneous action. Upon actuating either one or both of the switches, the main-power relay, which connects the drive motor to the power source, is deactivated. The participant need only exert a vertically downward thrust on either one of the safety handles in order to actuate the associated switch. The actuation threshold pressure is adjustable. Because the actuation pressure is adjustable, the handles may be grasped while the participant is using the machine and, in the event that the speed becomes excessive, the participant need merely push downward on one or both of the handles to actuate a switch that stops the machine. By using the inventive emergency switch assembly, the user of the exercise device may easily also be the operator of the exercise device. Thus, only one person is required to use the exercise machine.

The present invention also provides a frame assembly for use with a treadmill-type exercise apparatus. The frame assembly is intended for use with an exercise apparatus having an endless belt passing around an idler pulley and a driven pulley. Both of the pulleys are mounted for rotation about axles adjustably fixed with respect to frame members of the frame assembly. A motor has an output pulley connected to the driven pulley by a drive belt. With the inventive frame assembly of the present invention, the axle supporting the idler pulley is connected to the frame in such manner that either of its ends can be moved towards and away from the driven pulley. In this manner, proper tracking of the endless belt and proper belt tension are insured. Also, with the inventive frame assembly of the present invention, one end of the axle supporting the driven pulley is fixed with respect to one of the frame members, while the other end of the axle is adjustably connected to another of the frame members so that the driven pulley is adjustable to obtain precise alignment parallel to the main frame members. Further, the motor is adjustably connected to the frame assembly in such manner that the motor is movable towards and away from the driven pulley to obtain proper drive belt tension. Further, the driven and idler pulleys may be removed and installed quickly and easily.

Therefore, it is an object of the present invention to provide an emergency safety switch assembly for use in exercise apparatus, so that such apparatus may be immediately and instantaneously stopped.

It is also an object of the present invention to provide an emergency safety switch assembly for use in exercise apparatus, which has switches that may be actuated with very little travel and permit instantaneous actuation.

It is a further object of the present invention to provide an emergency safety switch assembly for exercise apparatus which has independently adjustable actuation threshold pressures.

It is still a further object of the present invention to provide an emergency safety switch assembly for exercise apparatus which employs safety handles which are both easy to reach and to grasp by the user of the apparatus.

Another object of the present invention is to provide an emergency safety switch assembly for exercise apparatus wherein the participant need exert only a downward vertical thrust on one of two handles to stop the action of the moving endless belt.

The manner in which these and other objects are accomplished in the present invention will be seen from the following detailed description of a preferred embodiment.

BRIEF DESCRIPTION OF THE DRAWINGS

In the detailed description of the preferred embodiment of the invention hereinafter presented, reference is made to the accompanying drawings, in which:

FIG. 5 is a partial view on line 5—5 of FIG. 2;

FIG. 6 is a partial view on line 6—6 of FIG. 2;

FIG. 7 is a partial view on line 7—7 of FIG. 2;

FIG. 8 is a top view of FIG. 7;

FIG. 9 is a cross-sectional view of a combination shaft and pulley assembly used with the inventive frame assembly;

FIG. 10 is a partial perspective of a motor mounting portion of the inventive frame assembly;

FIG. 11 is a partial view on line 11—11 of FIG. 12;

FIG. 12 is a partial view on line 12—12 of FIG. 11;

DESCRIPTION OF THE PREFERRED EMBODIMENT

Because treadmill-type exercise machines and apparatus are well-known, the present description will be directed in particular to elements forming part of, or cooperating more directly with, the present invention. Elements not specifically shown or described herein are understood to be selectable from those known in the art.

Figure 1:
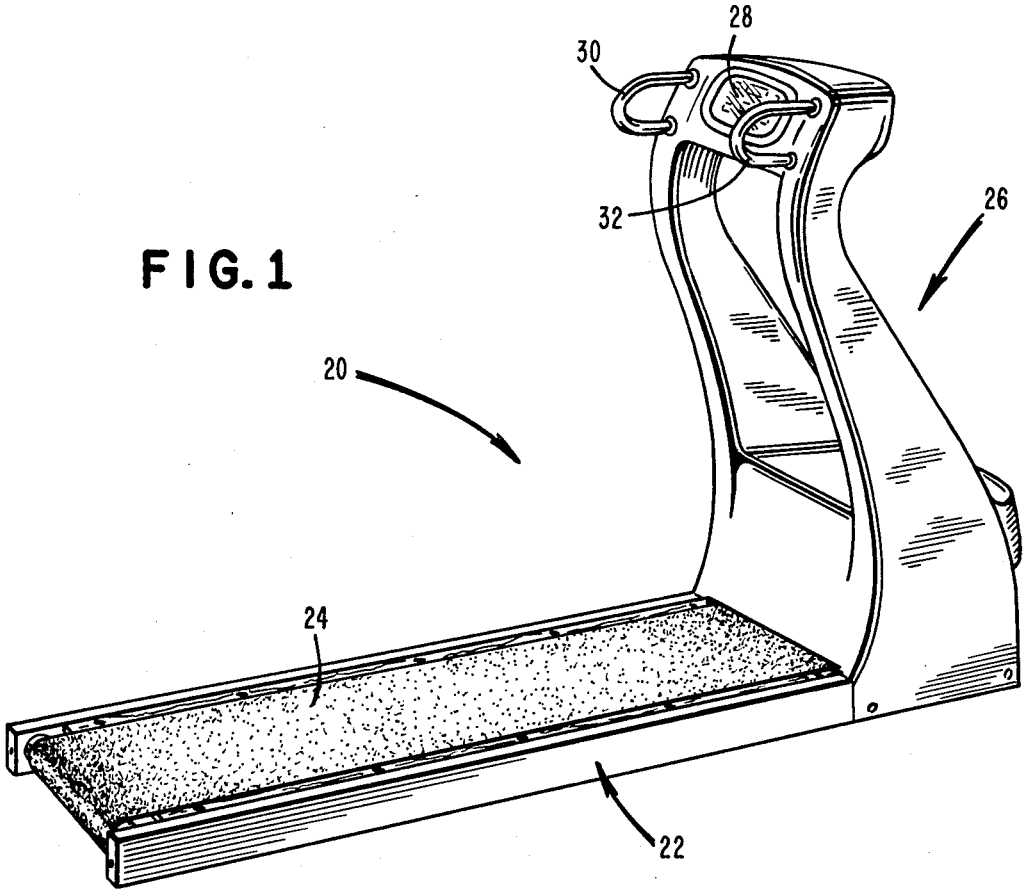
FIG. 1 is a perspective of an exercise machine incorporating a frame assembly and emergency shut-off switch assemblies according to the present invention.
Figure 2:
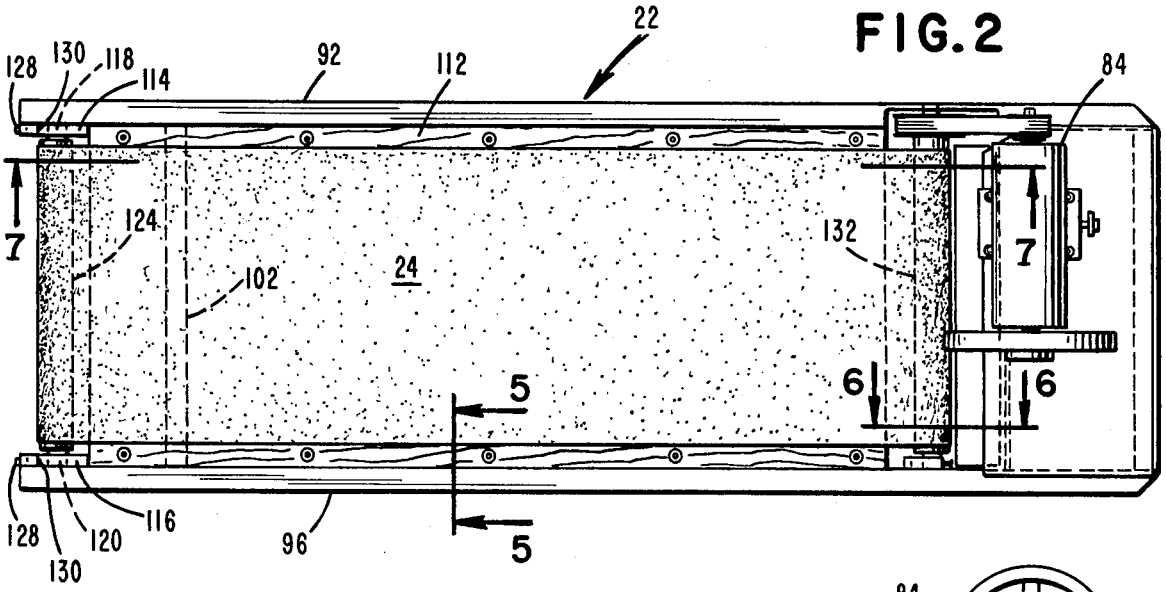
FIG. 2 is a top view of the inventive frame assembly, with the housing assembly removed.
Figure 3:
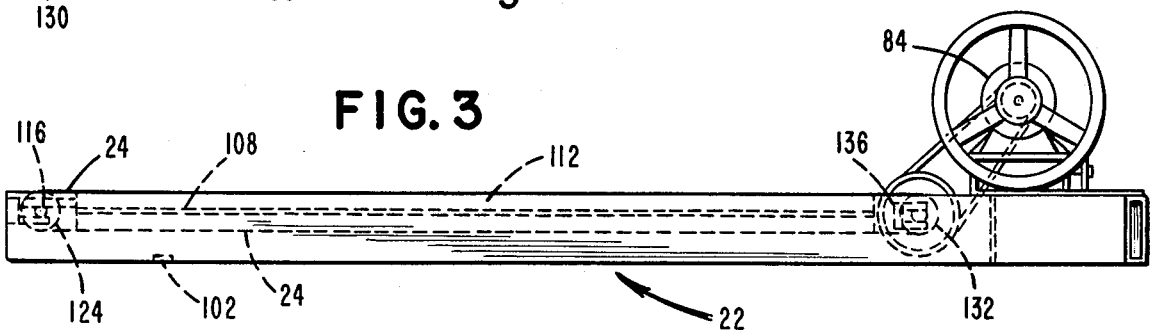
FIG. 3 is a side view of the frame assembly of FIG. 2.

Referring now to the drawings, FIG. 1 shows an exercise machine 20 having a frame assembly 22 supporting a moving treadmill or endless belt 24 and an upstanding housing assembly 26 releasably connected to the frame assembly 22. Preferably, the belt 24 has an elastomer outer surface supported by a no-stretch polyester backing. The housing assembly 26 is provided with a microprocessor controlled control panel 28, which has a conventional pressure operated on/off switch, speed controls, display dials, and lights, normally found in this type of machine.

The inventive safety switch system or assembly employs two safety handles, 30 and 32. These handles, 30 and 32, are formed of round pipe or steel tubing and have an arcuate configuration. Each of the handles has an upper end pivotally connected to the housing assembly 26 in such manner that a vertical downward movement of the handle results in movement of a protruding lower portion that actuates a switch of a switch assembly to disconnect power to a motor driving endless belt 24. To operate the inventive switch system, the participant on the exercise machine need only exert a downward thrust on either or both of the handles, 30 and 32. In this regard, and as may be seen in FIG. 1, the handles are positioned such that not only are the handles easy to grasp and to reach when a person is using the machine, but also the user may simply rest his hands on these handles during the operation of the machine, so that in the event an emergency stop is required, such stop is quickly and simply effected.

Figure 14:
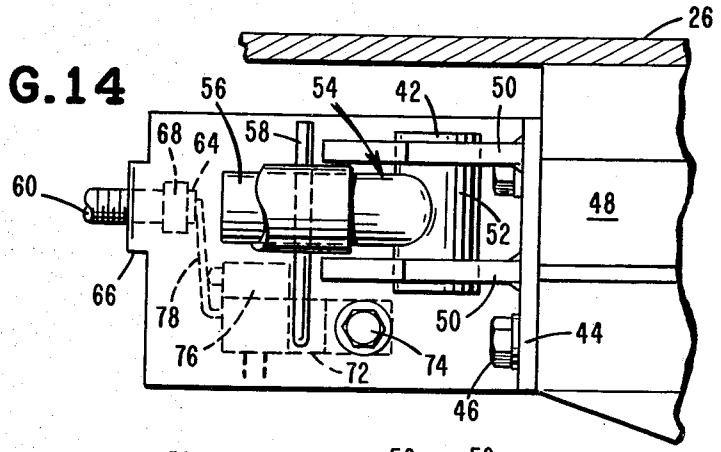
FIG. 14 is a top view of a handle mounting assembly of the exercise machine of FIG. 1 incorporating an inventive switch assembly.
Figure 13:
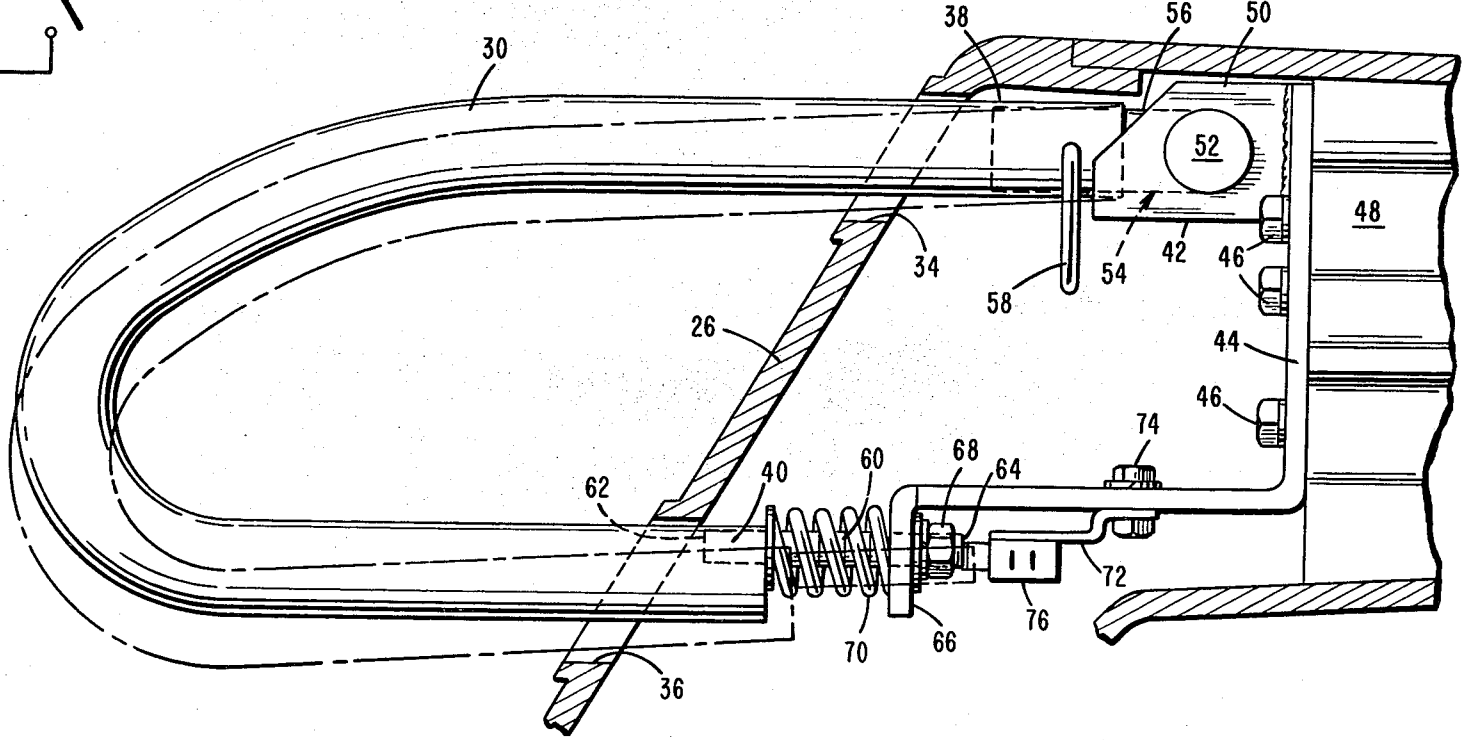
FIG. 13 is a schematic cross section of an upper portion of the housing assembly of the exercise machine of FIG. 1.

Referring now to FIGS. 13 and 14, the manner of connection of the safety handles 30 and 32 to the housing assembly 26 is illustrated. For the purposes of convenience, the manner of connection of safety handle 30 to the housing assembly 26 will be described. It should be appreciated that handle 32 is connected to the housing assembly 26 in a similar manner. As illustrated in FIG. 13, an upper portion of housing assembly 26 is shaped with an upper opening 34 and a lower opening 36 so that end portions 38 and 40 of the handle 30 are insertable into the interior of the housing assembly. Preferably, the safety handle 30 is formed from a tubular member having a hollow upper end portion connected to an upper portion 42 of a mounting bracket 44. The mounting bracket 44 is connected by a plurality of bolts 46 to reinforcing ribs 48 forming part of the housing assembly 26. The upper portion 42 of the mounting bracket 44 includes spaced apart plates 50 that pivotally support a cylindrically shaped base 52 of a holding member, generally designated 54. A shaft 56 protrudes from the base 52. The upper end portion 38 of handle 30 has openings formed therein alignable with corresponding openings in the shaft 56 for receiving a hitch pin 58 that releasably interconncts the holding member 54 and end portion 38. Thus, the holding member 54 provides a pivotable interconnection between the handle 30 and the mounting bracket 44.

A threaded shaft 60 has an inner end portion 62 fixedly connected to the interior of the lower end portion 40 of handle 30. An outer end portion 64 of the shaft passes through an aperture formed in a mounting flange portion 66 of the mounting bracket 44. A nut 68 is threadedly engaged with the outer end portion 64 to adjustably interconnect the shaft 60 to the mounting bracket 44. A spring 70 is positioned between the lower end portion 40 of the safety handle 30 and the mounting flange 66 to bias the handle away from the mounting flange.

A switch mounting plate 72 is connected by a bolt-and-nut connection 74 to a portion of the mounting bracket 44 in such manner that a switch assembly having a switch 76 carried by the mounting plate is positioned with an actuating member 78 adjacent to or in contact with the outer end of shaft 60. When the end portion 40 of handle 30 is moved into the housing assembly 26 by a vertical force on the handle, the shaft 60 moves the actuating member 78 to move the switch 76 from a normally open to a closed position.

In one embodiment of the invention, a spring 70 is used having a spring constant of 200 pounds per inch. By changing the position of the nut 68 on the outer end 64 of the shaft 60, it is possible to adjust the amount of force needed to actuate switch 76. Such actuating force can vary from a few pounds to as high as 70 pounds, or greater.

Figure 15:
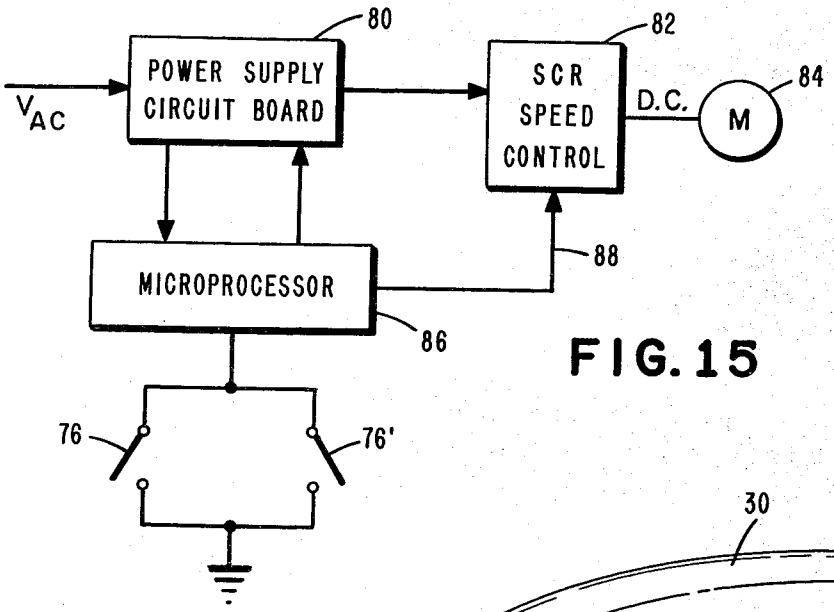
FIG. 15 is a schematic circuit diagram of the inventive switch assemblies incorporated in an operating circuit of the exercise machine.

Referring now to FIG. 15, the relationship between the emergency shut-off switch 76 and the control circuit of the apparatus 20 is illustrated. The exercise apparatus is connectable to a conventional alternating-current electric power source. The alternating current is furnished to a power supply circuit board 80 fed through a SCR speed control 82 that converts the alternating current into direct current fed to a D.C. motor 84. A microprocessor 86 controls both the power supply circuit board 80 and speed control 82. Preferably, the microprocessor 86 is positioned in the housing assembly 26 behind the control panel 28.

In one embodiment of the invention, the microprocessor is controlled by sensory-touch control buttons and includes a digital readout display. Suitable buttons include an on/off control that is pressed and released to turn the machine on and to light up the readout display. Subsequent pressing and releasing of the button turns the display panel and motor off. The digital readout displays alternately, at intervals of approximately six seconds, functions such as, heart rate, speed, distance, and time. Speed is calculated to the nearest 0.1 mile per hour and is displayed from about 1.0 to 8.0 mph. Speeds less than 1.0 mph are displayed with a zero. Distance display is to the nearest 0.01 mile and shows accumulated distance up to 9.99 miles. The time indicator works like a stop watch and keeps time to the nearest 0.1 minute. The maximum readout is 99.9 minutes. Heart rate is only displayed when heart rate belt is used. Speed control is provided by separate speed increase and speed decrease buttons. Speed is increased or decreased depending upon which button is depressed. A hold control button is provided so that the display continuously monitors a selected one of the information modes (speed, distance, heart rate, or time). A reset control is provided to automatically reset the distance and time readings to 0.0 for monitoring distance and time sequences.

In operation, after the apparatus 20 has been connected to a suitable power source, pressure is applied to the on-off button on the control panel 28 to turn the apparatus on and light up the display panel. Pressure on the speed increase button transmits a signal over a line 88 to the speed control 82 so that the motor 84 is energized to start movement of the belt 24. The belt speed continues to increase as long as pressure is applied to the speed increase button. until a maximum speed, such as, 8 mph, is reached, In a similar manner, the speed of the belt is gradually decreased by pressure on the speed decrease button. Subsequent pressure on the on-off switch of the microprocessor 86 turns the motor off and the belt gradually stops.

If, during use, a user looses balance or experiences sudden pain, the apparatus can be immediately shut-off and the belt stopped by grasping handle 30 to close switch 76, or by grasping handle 32 to actuate a switch, designated 76', similar to switch 76. Actuation or closing of either or both the switch 76 and the switch 76' results in immediate stopping of the motor 84. On the other hand, when pressure is applied to the on-off switch of the microprocessor 86 to stop the apparatus, there is a slight delay, for instance, of approximately two or three seconds, before the motor stops.

Preferably, a circuit breaker (not shown) is positioned between the power source and the power supply circuit board 80. The circuit breaker is accessible from the exterior of the housing assembly 26 to enable switching off the apparatus when not in use to prevent unauthorized users from simply turning the apparatus on by pressure on the on-off switch. Also, since the microprocessor 86 is continually on, even when the on-off switch is not closed, opening of the circuit breaker switch will shut off the microprocessor.

The inventive frame assembly 22 and its relationship with other components of the machine 20 now will be described with reference to FIGS. 2 to 8. The frame assembly 22 is comprised of a first frame or tubular member 96, a second frame or tubular member 92 parallel to and spaced from the member 96, an end tubular member 98, a third tubular member 100 aligned with the second tubular member 92, and a plate member 94 interconnecting confronting ends of tubular members 92 and 100. The plate member 94, which is generally U-shaped, has flanges welded to confronting ends of the second and third tubular members. A spacer bar 102 interconnects portions of the members 92 and 96 to each other. A motor mounting plate 104 is welded to upper surfaces of the tubular members 96, 98 and 100. A safety plate 106 is connected to an edge of the plate 104 to close a gap between the mounting plate and the endless belt 24. Angle bars 108, 110 are welded to confronting inner surfaces of the tubular members 96, 92, respectively. The angle bars support a slider bed 112, preferably formed of a silicone impregnated hardwood. Through bores are formed in the bed and angle bars so that the bed is connected to the frame by lock washers and nuts secured to threaded bolts.

U-shaped holding brackets 114 and 116 are welded to confronting portions of the members 92 and 96 rearwardly of ends of the angle bars 108, 110. These brackets are used to adjustably interconnect the ends 118, 120 of a shaft or axle 122 supporting an idler pulley 124. As illustrated in FIG. 9, end portions of the shaft 122 support bearing races 126 that, in turn, support the pulley 124 for rotation about the shaft 122. Each of the end portions 118, 120 of the shaft 122 has a threaded through bore formed therein for receiving a threaded bolt 128. As illustrated in FIG. 7, the head of the bolt is maintained in contact with the base of the holding bracket (116 or 114), while the shaft of the bolt is engaged with the bore in the end of the shaft to interconnect the shaft 122 with the frame assembly 22. By turning the bolt clockwise, the end of the pulley is moved toward the head of the bolt. To assist in initial alignment of the shaft 122, pulley adjustment lines 130 are located on appropriate portions of the frame assembly.

A driven pulley 132 mounted on a shaft or axle 134 similar to axle 122 is connected to the frame assembly 22 between the slider bed and motor mounting plate 104. A U-shaped holding bracket 136 is welded to an inner surface of member 96 for adjustably holding an end 138 of the axle 134. As illustrated in FIG. 6, rotation of a threaded bolt 140 received in a threaded bore formed in the end 138 results in changing the angular orientation of the axle 134 with respect to the frame assembly 22. The other end 142 of the axle 134 has a shape complimentary to the shape of an opening 144 formed in plate member 94.

Figure 4:
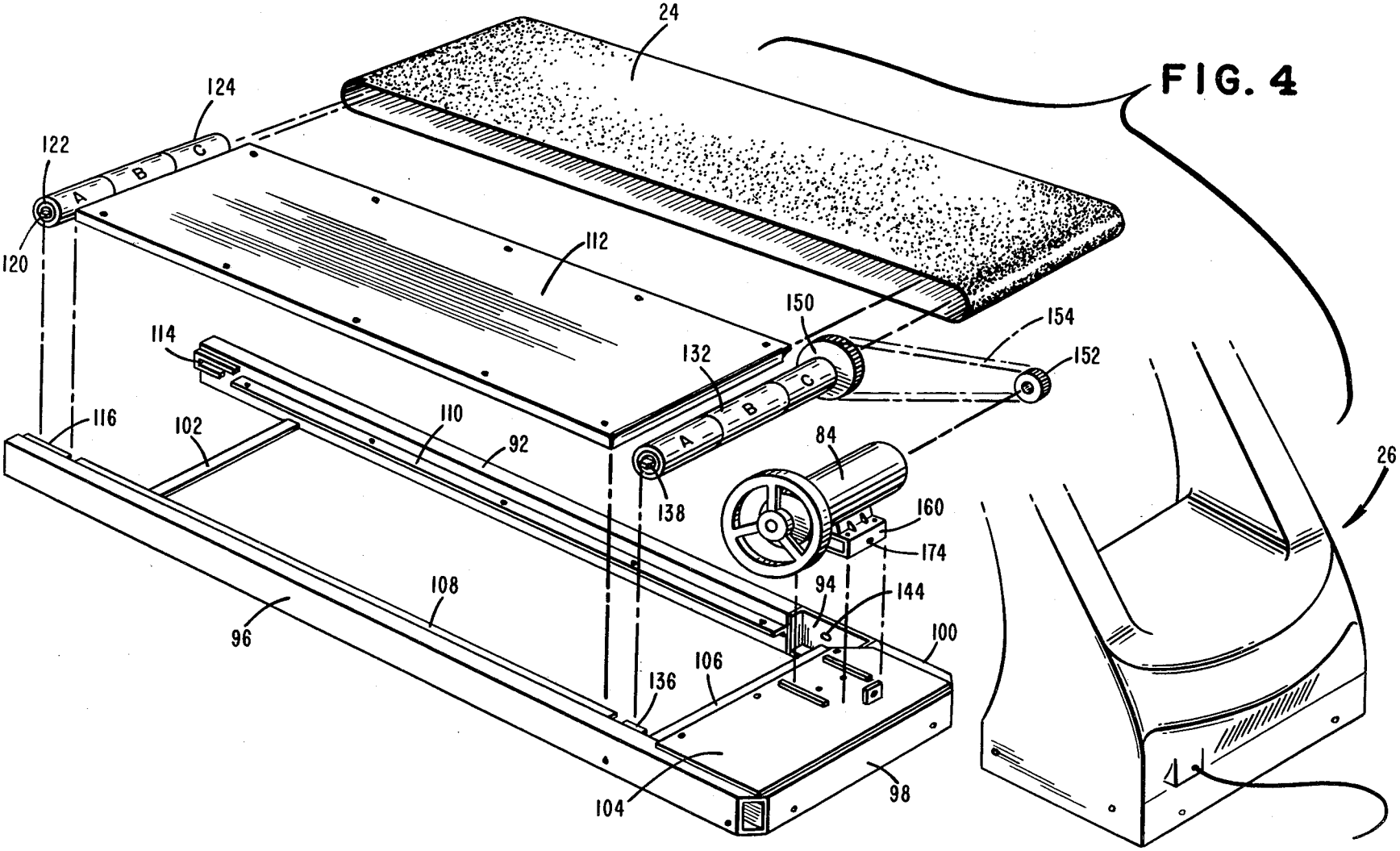
FIG. 4 is a schematic exploded perspective of the inventive frame assembly and a portion of the housing assembly.

As schematically illustrated in FIGS. 4 and 9, each of the pulleys 124 and 132 has a central portion B and outer portions A and C that are downwardly tapering from the central portion B to the outer edges of the pulleys. The angle of taper is represented, slightly enlarged, by the angle alpha (a) in FIG. 9. Design of the pulleys in this manner results in self centering of the belt 24 on the pulleys, once the orientation of the axles 122 and 134 has been appropriately adjusted parallel by turning of the bolts 128. The driven pulley 132 includes an enlarged end portion 150 that forms a gear wheel connectable to a drive timing pulley 152 by a drive timing belt 154. As previously described, end 138 of pulley 132 is translatable with respect to frame member 96 to insure proper alignment of end portion 150 with the pulley 152.

The mounting of motor 84 on the frame assembly 22 will be described with reference to FIGS. 4 and 10 to 12. Flanges 154 extend downwardly from motor 84 for connecting the motor to a motor mounting plate 156. The mounting plate 156 is connected by bolt-and-nut connections 158 to an upper surface of a motor base 160. For this purpose, the mounting plate 156 has longitudinally-extending openings 162 formed therein so that the mounting plate is translatable with respect to the motor base 160.

The motor base 160 has a top surface 164 having openings formed therein to allow passage of the bolt-and-nut connections 158 and a bottom surface 166 having longitudinally-extending openings 168 similar to the openings 162 formed in the motor mounting plate 158. Bolt-and-nut connections 169 have shafts passing through the openings 168 and an opening formed in the mounting plate 104 for adjustably interconnecting the motor base 160 to the mounting plate 104. The top and bottom surfaces are interconnected by a front plate 170 and a rear plate 172. An opening is formed in the front plate 170 for the passage of a threaded shaft of a bolt 176. A nut 178 is welded to an inner surface of plate 170 for threadedly engaging the shaft of bolt 176. An upstanding plate 180 is welded to an upper surface of the mounting plate 104 and has an opening formed therein for passage of the shaft of bolt 176. After the bolt-and-nut connections 169 have been loosened, turning of bolt 176 results in translation of the base 160 to thereby adjust tension in the belt 154. During such movement, side edges of the bottom of the motor base are guided by parallel strips or bars 182 welded to an upper surface of mounting plate 104. Preferably, when the apparatus is initially assembled, the motor base 160 is positioned on the mounting plate 104 and rotated to insure proper alignment between pulley 152 and end portion 150 of the driven pulley 132. Once such proper alignment has been obtained, the plates 182 are welded to the plate 104 to maintain the desired orientation. The inventive frame assembly makes it possible to both maintain proper drive belt tension and proper orientation between the driving pulley 152 and driven pulley 150.

The inventive frame assembly 22 provides several advantages. For instance, if it is desired to lubricate the slider bed 112 after extended use of the exercise machine, such lubrication is easily accomplished. First, bolts 128 are rotated to move the idler pulley 124 towards the driven pulley 132 thereby removing tension from belt 24. Belt 24 is then raised and an appropriate lubricant, such as a silicone spray, is applied to the slider bed 112. Bolts 128 are then rotated to position the idler pulley 124 in rough alignment with the pulley adjust lines 130. Power is then furnished to motor 84 to start rotation of belt 24. If the belt starts to move towards one end of idler pulley 124, one of the bolts 128 is rotated to appropriately center the belt. Similarly, when it is desired to replace the belt, bolts 128 are rotated out of the bores in the ends 118 and 120 of the axle 122. End 138 of the driven pulley 132 can then be removed from the holding bracket 136. After end 138 of the axle 134 has been removed from the bracket 136, end 142 of the axle is removed from the opening 144 in frame member 94. Next, the slider bed 112 is separated from the angle bars 108 and 110. The belt 24 is then removed from the pulleys and bed and replaced with a new belt. Reassembly of the machine takes place in reverse order.

Previously, a specific embodiment of the present invention has been described. It should be appreciated, however, that this embodiment has been described for the purposes of illustration only, without any intention of limiting the scope of the present invention. Rather, it is the intention that the present invention be limited not by the above but only as is defined in the appended claims.

What is claimed is:

1. In an exercise machine of the treadmill type having a frame assembly, a housing assembly supported by the frame assembly, a motor positioned within said housing assembly, an endless belt driven by the motor and guided by the frame assembly, and manually operated switch means for controlling starting and stopping of the motor, the improvement comprising an emergency shut-off switch assembly for substantially instantaneously de-energizing the motor to thereby stop belt movement, said emergency shut-off switch assembly comprising:

first and second handles having upper and lower ends connectable to said housing assembly in such manner that said handles are positioned to be grasped by a user of the exercise machine;

means for pivotally connecting each of the upper ends of said handles to said housing assembly;

means for connecting each of the lower ends of said handles to said housing assembly including spring-biasing means for biasing the lower ends of the handles away from the housing assembly and in such manner that each of the lower ends is independently movable towards said housing assembly when a force sufficient to overcome said spring-biasing means is applied thereto; and first independent switch means positioned in said housing assembly a predetermined distance from the lower end of said first handle and second independent switch means positioned in said housing assembly a predetermined distance from the lower end of said second handle, each of said first and second independent switch means being actuatable by the means for connecting the lower ends of said handles to the housing assembly by movement exceeding a predetermined amount of its associated handle lower end toward said housing for substantially instantaneously de-energizing the motor to thereby stop belt movement.

2. The emergency shut-off switch assembly of claim 1, wherein said first and second handles are hollow tubular members, and wherein said means for pivotally connecting comprises a holding member having spaced apart plates supported by said housing assembly, a cylindrical shaped base rotatably supported by said plates, and a shaft protruding from the base, said shaft protruding into the upper end of a respective one of said handles and being releasably interconnected thereto.

3. An emergency shut-off switch assembly according to claim 1, wherein said means for pivotally connecting and said means for connecting comprise mounting brackets connected to interior portions of said housing assembly for connecting respective ones of said first and said second handles to said housing assembly, each of said mounting brackets having an upper portion supporting said means for pivotally connecting and a lower portion supporting said means for connecting.

4. An emergency shut-off switch assembly according to claim 3, wherein respective ones of said first and said second independent switch means are carried by respective ones of said mounting brackets.

* * * * *